United States Patent [19]

Heaney

[11] 4,087,139

[45] May 2, 1978

[54] GUIDE FOR FASTENER

[75] Inventor: James J. Heaney, Glendale, Calif.

[73] Assignee: Anthony's Manufacturing Company, Inc., San Fernando, Calif.

[21] Appl. No.: 687,046

[22] Filed: May 17, 1976

[51] Int. Cl.[2] ..... B25G 3/00

[52] U.S. Cl. ..... 312/138 R; 312/214; 403/7; 49/60

[58] Field of Search ..... 312/138 R, 320, 265, 312/214; 49/70, 460; 403/6, 7; 16/110 R; 29/451

[56] References Cited

U.S. PATENT DOCUMENTS

| | | | |
|---|---|---|---|
| 1,037,720 | 9/1912 | Baumruk | 49/460 |
| 2,075,495 | 3/1937 | Aten | 49/460 |
| 2,104,217 | 1/1938 | Barnes | 292/365 |
| 3,013,922 | 12/1961 | Fisher | 312/214 |
| 3,059,736 | 10/1962 | Boyd | 403/7 |
| 3,079,185 | 2/1963 | Foster | 403/7 |
| 3,129,472 | 4/1964 | Hensel | 403/7 |
| 3,164,869 | 1/1965 | Barkan | 312/214 |
| 3,305,626 | 2/1967 | Mohr et al. | 29/451 |
| 3,673,735 | 7/1972 | Winsler et al. | 49/70 |
| 3,828,415 | 8/1974 | Kammeraad et al. | 29/451 |

FOREIGN PATENT DOCUMENTS

| | | | |
|---|---|---|---|
| 980,768 | 4/1965 | United Kingdom | 16/110 R |

*Primary Examiner*—Robert L. Wolfe
*Assistant Examiner*—Victor N. Sakran
*Attorney, Agent, or Firm*—Kleinberg, Morganstern, Scholnick & Mann

[57] ABSTRACT

A guide to assist in inserting a fastener into a first hole in a first surface which is accessible through a second hole in a wall facing the first surface, comprises a plastic tube press-fitted through the second hole, extending to and surrounding the first hole. A thin plate overlying the wall contains a hole concentric with the second hole but whose diameter is smaller than the fastener, whereby the fastener is held captive within the tube.

7 Claims, 3 Drawing Figures

GUIDE FOR FASTENER

BACKGROUND OF THE INVENTION

1. Field of the Invention

The present invention is in the field of refrigerated display cases and in particular relates to a device for facilitating attachment and removal of the door handle from the door frame.

2. The Prior Art

Typically, refrigerated cabinet doors of the prior art included two or more panes of glass mounted in a metallic door frame member. The door frame member typically consists of a metallic extrusion of U-shaped cross section. The panes of glass are held between the tips of the U, and the handle is attached to one of the side flanges of the extrusion. To preserve the attractive appearance of the door, it is known to provide the surface of the handle which lies against the door frame with a tapped hole and to attach the handle to the frame by a screw extending from inside the U-shaped channel, through a clearance hole in its side flange, and into the tapped hole in the door handle.

This construction has a disadvantage in that the head of the screw that holds the handle is inside the door frame is thus inaccessible after the door has been assembled. To relieve this difficulty, it is known to provide an access hole in the side flange opposite the handle for insertion of a screwdriver or Allan wrench.

It is known in the art to provide a decorative trim strip on the front surface of the door frame, which typically extends also between the handle and the door frame. It is sometimes necessary to remove the door handle to install or replace this decorative trim.

It is also known in the art to provide the door frame with an overlying plastic molding extending around those portions of the door frame member which normally are nearest the inside of the refrigerator. The plastic molding serves several useful purposes. It acts as a thermal break, hides the access holes, enhances the appearance of the unit and serves as a means for attaching a sealing strip about the periphery of the door. In some prior art doors, the plastic molding covered the frame portion which contained the access holes thus necessitating removal of the molding to expose the access holes.

With the door construction of the prior art it has thus been difficult to tighten the handle or to replace it. First, it was necessary to remove the plastic molding; this was both time consuming and potentially damaging to the molding. Thereafter, a tool was inserted through the access hole to drive the screw holding the handle in place. In the process, it was found that not infrequently the screw would, when disengaged, fall from the tool and become permanently lost within the channel. A number of screws might become lost in the process of replacing a door handle. This necessitated maintaining a supply of such screws in the field. Installing and maintaining the door handle was rendered a time consuming and tedious proposition. Screws lost in the channel could cause a rattling sound when the door was opened and closed, which would necessitate disassembly of the door frame to remove the lost screws.

SUMMARY

The present invention provides a device permitting the door handle to be replaced or tightened with ease. Because the screw that holds the handle in place is held captive by the device of the present invention, the screw cannot fall down inside the channel and thus it is not necessary to provide or maintain a supply of such screws in the field.

With the device of the present invention, the doors can be shipped with the handles removed and the handle can be attached easily by the purchaser. Because shipping costs are based in part on the volume of the package containing the door, removal of the handle results in a streamlined shipping package and consequent saving of shipping costs. Further, the handle can be removed to facilitate moving the door through narrow places.

Once the door has been shipped to its destination, the handle can be attached by unskilled personnel. Later, it is easy to replace the handle should it become broken in use or should the purchaser decide to install a handle of a different style. If the handle becomes loose with use, it may be easily tightened. Also, the present invention simplifies replacement of the decorative strip which extends between the door handle and the door frame.

These advantages are achieved according to the present invention by providing a small plastic tube leading from the access hole to the clearance hole for the screw that holds the handle in place. This tube prevents the screw when disengaged from the threaded hole from falling down inside the channel and becoming lost. Further, the tube provides a guiding action to the screw further facilitating its use. In a preferred embodiment, the tube is press-fitted through the access hole and is held in place by the clamping action of the periphery of the access hole as it bears against the outer surface of the tube.

In the preferred embodiment, a plate covers the access hole in the extrusion, and the plate has a hole concentric with the access hole but having a smaller diameter. The diameter of the hole in the plate is smaller than the diameter of the screw head, thereby preventing the screw from falling out the end of the tube. In another preferred embodiment, the plastic molding strip can perform the same function as the plate. Alternatively, both the plate and the plastic molding strip can be used, the plastic molding strip covering the plate to provide a pleasing external appearance.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
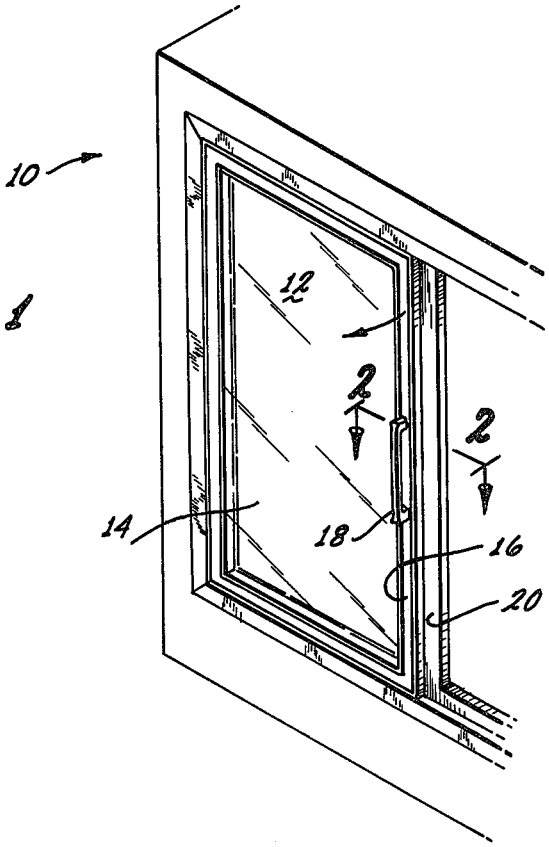
FIG. 1 is a perspective view showing a refrigerated cabinet door in which the present invention is used.

Referring now to the drawings, in FIG. 1 there is shown a refrigerated display cabinet of the type in which a preferred embodiment of the present invention is employed. The refrigerated display cabinet 10 has a door 12 which includes a glazed portion 14 for displaying the merchandise therein. The glazed portion 14 is supported and protected by a door frame 16 which surrounds the glazed portion 14. A handle 18 is provided to facilitate opening door 12. When the door is in its normally closed position shown in FIG. 1, a portion of the door 12 is in sealing contact with mullion 20, a stationary portion of the door mounting frame.

Figure 3:
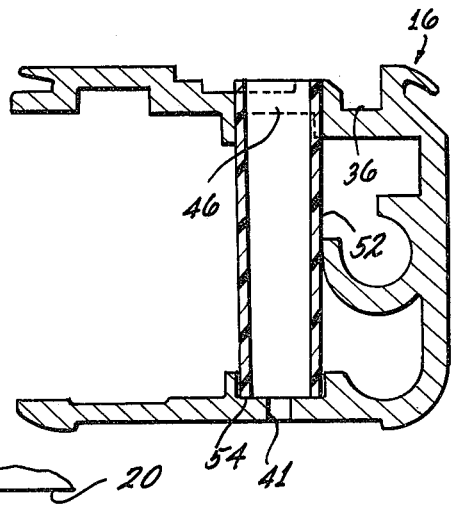
FIG. 3 is a cross sectional view taken in the direction shown in FIG. 1, but with several parts omitted in the interest of clarity.
Figure 2:
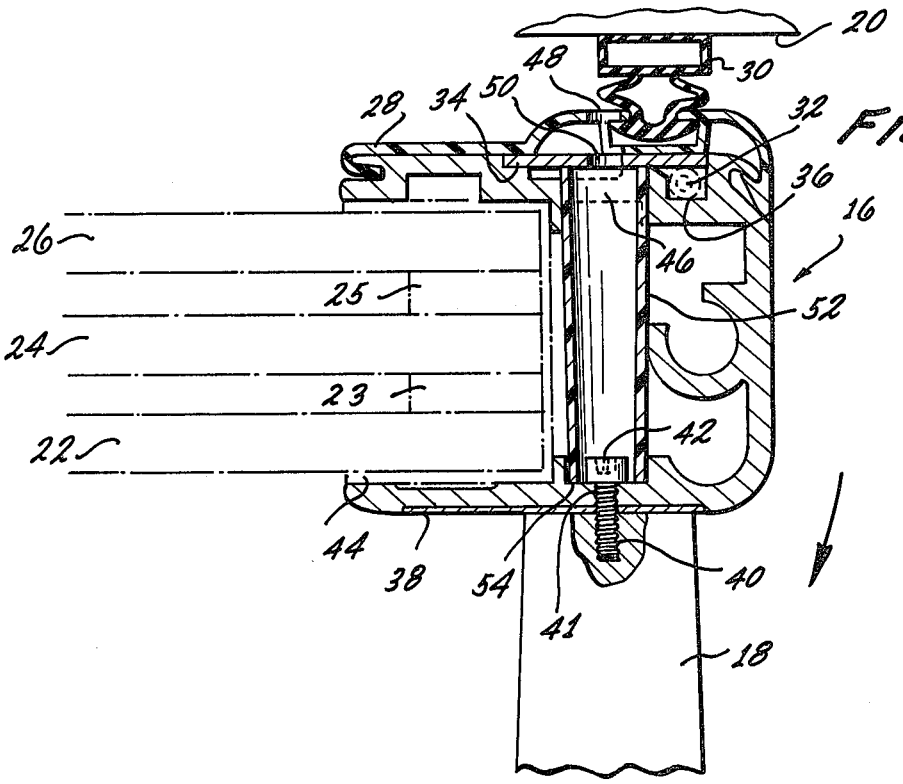
FIG. 2 is a cross sectional view taken in the direction shown in FIG. 1 showing the device of the present invention installed within the door frame.

FIGS. 2 and 3 are cross-sectional views taken in the direction 2—2 shown in FIG. 1. From FIGS. 2 and 3 it can be seen that door frame 16 is a U-shaped channel. The main purpose of channel 16 is to support the panes 22, 24 and 26 which make up the glazed portion 14 of the door 12 of FIG. 1. Although three panes are shown in the embodiment of FIG. 2, it is understood that such doors are normally constructed with two or more panes.

The door frame 16 is normally provided with a removable plastic molding 28 which enhances the appearance of the unit and which is used for attaching the magnetic sealing gasket 30 to the door frame 16. The magnetic sealing gasket 30 sealingly engages mullion 20 when the door is in its normally closed position, to prevent warm air from entering the refrigerated cabinet.

The door frame 16 may also be provided with an electrical heating wire 32 to provide localized heating of the door frame 16 thereby preventing the formation of condensation and frost on it. A thin metal strip 34 is used to hold the electrical heating wire 32 in its slot 36. The thin metal strip 34 is held in place by the plastic trim strip 28.

The door frame 16 may also be provided with a decorative trim strip 38 for enhancing the appearance of the door. Decorative trim strip 38 is normally attached by adhesive to the door frame 16, and the handle 18 is then attached over the decorative strip 38. In one embodiment, the door handle 18 is provided with a threaded hole 40 for receiving an Allan-headed screw 42, by which the handle 18 is attached to the door frame 16.

The door 12 is constructed by separating the glass panes 22, 24 and 26 by spacers 23, 25 and then applying a hermetic sealing coating around the edges of the unit thus formed. A resilient spacer 44 is then slipped over the edge of the unit and door frame 16 is then slipped into place. Once the door frame 16 has been attached to the multi-pane glazed unit, a hollow volume is formed within the closed end of the door frame 16 and extending the length of the door frame.

It is known in the art to provide an access hole in the door frame to permit access to the screw used for holding the handle in place. In practice it has been exceedingly troublesome to remove or replace the screw. It was necessary to insert the Allan wrench through the access hole and to search blindly for the head of the screw. Once the screw was disengaged from the threaded hole, it frequently would fall off the end of the Allan wrench and become permanently lost in the empty volume at the closed end of the door frame.

Further, in certain doors known to the prior art, no access was provided in the plastic molding and therefore it was necessary to remove the plastic molding to reach the access hole. This is time-consuming and sometimes results in damage to the plastic molding.

In the preferred embodiment of the present invention, the plastic molding 28 is provided with an access hole 48, and likewise the thin metal strip 34 is also provided with an access hole 50, whereby, in the preferred embodiment of the present invention, it is not necessary to remove the plastic trim strip 28 from door frame 16 to reach access hole 46.

It is highly advantageous to ship the refrigerator door 12 to the place where it will be installed, with the handle 18 removed from the door frame 16. Shipping costs are known to be based on the cubage or cubic measurement of the door frame and the presence of the handle in the installed position increases the shipping costs. Further, the possibility of damage to the handle during shipment must be considered. As a result, it is highly desirable that the handle be affixable to the door frame in the field, i.e., at the location of the installation.

Once the door has been installed in the refrigerated display cabinet, it is sometimes found desirable to be able to replace the decorative trim strip 38 or to install a new handle 18. The new handle might be either a replacement for a damaged handle or might be a handle having a different style.

Whenever the handle or the decorative trim strip of the prior art doors were to be replaced in the field, the above described difficulties arose. That is, it was necessary to remove the plastic molding and to blindly position the screw into the threaded hole of the handle.

These difficulties have been overcome by the present invention. In the present invention, a guide tube 52 is provided for guiding the screw 42 into the clearance hole 41. In a preferred embodiment, the guide tube 52 is made of plastic and is tapered, having a larger diameter at access hole 46 and a smaller diameter nearest the clearance hole 41. In the preferred embodiment, the diameter of the guide tube 52 is slightly larger than the diameter of access hole 46, and the guide tube 52 is press-fitted through access hole 46. The tightness of the fit helps to hold the guide tube 52 in its proper position.

The length of the guide tube is such that its larger end extends through access hole 46 when the tube is in place, and its smaller end butts against surface 54 when the guide tube is in its proper position. The inner diameter of the smaller end of the guide tube 52 is preferably only slightly larger than the head of the screw 42, so that when the screw has been pushed to the small end of the tube, it is positioned approximately at the clearance hole.

An important feature of Applicant's invention is that the thin metal strip 34 which holds the electrical heating wire 32 in place is provided with an access hole 50 whose diameter is adequate to pass the Allan wrench, but which is too small to permit the screw 42 from falling out through it. If the strip 34 is not used, the access hole 48 in the plastic molding can be sized so that its diameter is large enough to pass the Allan wrench but too small to permit the screw 42 from falling through it. In this manner, the screw 42 is held captive within the guide tube 52 and can neither become lost within the door frame nor can it fall through the access hole and be lost. In either case, the guide tube has been found to be extremely helpful in facilitating installation and removal of the handle 18 from the door frame 16, significantly reducing the time required to perform these operations.

The guide tube 52 in a preferred embodiment is injection molded of a plastic material. The exact formulation of the plastic is of no concern, the choice being dictated by cost.

Although normally the guide tube 52 is installed in the door frame 16 during the initial assembly of the door 12, it is possible to retrofit the guide tube into existing door frames including those already installed in refrigerated display cabinets.

While the preferred embodiment has been described in terms of the use of a screw 42 to hold the handle 18 in place, it is obvious to those skilled in the art that other types of fasteners can be used in place of the screw described.

Thus, there has been described a guide tube for a fastener that greatly facilitates removal and replacement of the handle of a refrigerated display cabinet door. The guide tube directs the fastener to the appropriate point and prevents the fastener from becoming lost within the door frame. The guide tube in association with the small access holes in the thin metal strip that covers the heating wire groove and the small access hole in the plastic molding retains the fastener captive within the guide tube, where it is always available for use.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. An assembly for use in the door of a refrigerated cabinet, comprising:

a substantially U-shaped channel member having two spaced opposed side flanges for use as the structural portion of the door frame, said channel member having a first hole in a first side flange, and having a second hole in a second side flange aligned with said first hole;

a handle having a surface normally in contact with a surface of said first side flange facing away from said second side flange of said U-shaped channel, said handle surface having a fastener-retaining hole extending into it and aligned with said first hole; and a tube abutting said first and said second side flanges and extending from and surrounding said first hole and fixed in position about said first hole in alignment with said second hole, to and surrounding said second hole, providing a guideway for directing a fastener separate from said tube toward said first hole.

2. The assembly of claim 1 further comprising a fastener extending through said first hole and into said fastener-retaining hole, said fastener securing said handle to said channel member.

3. The assembly of claim 2 further comprising a plate normally overlying the outer surface of said second side flange, said plate having an access hole substantially concentric with said second hole and a diameter less than the diameter of said fastener, whereby, when said plate is in its normal position said fastener is held captive within said tube.

4. The assembly of claim 2 further comprising a plastic molding normally overlying the outer surface of said second side flange, said plastic molding having an access hole substantially concentric with said second hole and a diameter less than the diameter of said fastener, whereby, when said plastic molding is in its normal position said fastener is held captive within said tube.

5. The assembly of claim 1 wherein said tube is press-fitted through the second hole.

6. The assembly of claim 1 wherein said tube is tapered with the narrower tapered end positioned adjacent said first hole.

7. The assembly of claim 1 wherein said tube is fabricated of plastic.

* * * * *